United States Patent [19]

Graves

[11] 4,131,819

[45] Dec. 26, 1978

[54] LEAD WIRES FOR INCANDESCENT LAMP

[75] Inventor: James A. Graves, Euclid, Ohio

[73] Assignee: General Electric Company, Schenectady, N.Y.

[21] Appl. No.: 879,323

[22] Filed: Feb. 15, 1978

[51] Int. Cl.[2] ..... H01J 5/50

[52] U.S. Cl. ..... 313/331; 313/271

[58] Field of Search ..... 313/269, 271, 275, 276, 313/331

[56] References Cited

U.S. PATENT DOCUMENTS

| | | | |
|---|---|---|---|
| 2,198,919 | 4/1940 | Prideaux | 176/16 |
| 3,007,073 | 10/1961 | Swasey | 313/277 |
| 3,007,074 | 10/1961 | Swasey | 313/277 |
| 3,114,069 | 12/1963 | Peek et al. | 313/269 |

*Primary Examiner*—Alfred E. Smith
*Assistant Examiner*—Robert E. Wise
*Attorney, Agent, or Firm*—Paul F. Wille; Lawrence R. Kempton; Frank L. Neuhauser

[57] ABSTRACT

Lead wires having a specified stiffness, ie. stress/strain, characteristic are described for use in an incandescent lamp.

5 Claims, 3 Drawing Figures

WIRES FOR INCANDESCENT LAMP

BACKGROUND OF THE INVENTION

This invention relates to electric lamps and, in particular, to an improved lead wire for incandescent lamps.

In the prior art, various materials have been used for lead wire in electric lamps. A recurring problem has been the weakening or annealing of the lead wire during glass forming operations. As a specific example, in making incandescent lamps, the lead wires and exhaust tube are inserted into a flare and the smaller end of the flare is heated and pressed to make what is known as the stem.

The stem press operation softens the lead wires to the point that tie wires are used to assure lamp reliability, particularly against shock. The button forming and tie wire operations add steps to the manufacture of lamps, increasing cost and adding a possible source of shrinkage (rejected lamps). Alternatively, simply removing the tie wires may result in premature failure of the lamp in use. Specifically, the heat from the filament anneals the leads somewhat reducing the stiffness thereof. Subsequent shock may deform the lead wires such that the filament is spatially deformed, which can lead to immediate or premature filament failure.

SUMMARY OF INVENTION

In view of the foregoing it is therefore an object of the present invention to provide an improved lead wire for electric lamps.

Another object of the present invention is to provide a lead wire which enables one to eliminate tie wires without sacrificing the shock resistance of the lamp.

A further object of the present invention is to provide an improved inner lead for an electric lamp which partially absorbs a shock given the lamp.

Another object of the present invention is to provide inner leads having specified stiffness such that the leads vibrate together within the lamp to reduce spatial distortion of the filament due to shock.

The foregoing objects are achieved in the present invention wherein it has been discovered that by specifying the stiffness of the inner lead for the lamp in the "as received" condition, ie. before being placed into service, lamps are provided with superior inner leads which eliminate the need for tie wires yet do not sacrifice the shock resistance of the lamp.

BRIEF DESCRIPTION OF THE DRAWING

A more complete understanding of the present invention can be obtained by considering the following detailed description in conjunction with the accompanying drawing, in which.

DESCRIPTION OF THE PREFERRED EMBODIMENTS

Figure 1:
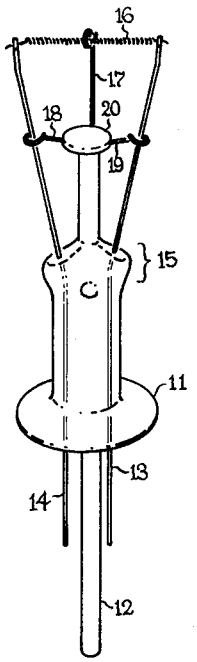
FIG. 1 illustrates a mount for an incandescent lamp in accordance with the prior art.

FIG. 1 illustrates a completed mount in accordance with the prior art. Specifically, the mount comprises a flare 11 having exhaust tube 12 and lead wires 13 and 14 inserted therein. As known to those of skill in the art, [illegible] 13 and 14 each comprise three segments of conductive material. Specifically, lead wires generally comprise an outer conductor connected to an inner conductor by a short length of dumet wire which is positioned in pressed area 15 to provide a seal between the inside and outside of the glass envelope of the lamp. As illustrated in FIG. 1, the upper portion of the stem is inserted into the glass envelope. Thus, the portions of lead wires 13 and 14 extending upwardly from pressed area 15 constitute the inner lead wires while the portions of lead wires 13 and 14 extending downwardly from pressed area 15 constitute the outer lead wires.

The ends of the inner lead wires are connected one each to each end of refractory filament 16, generally comprising tungsten. Encircling the central portion of filament 16 is support wire 17. Encircling each of lead wires 13 and 14 are tie wires 18 and 19, the other ends of which are embedded in glass button 20 formed in the end of the exhaust stem.

The operation of a lamp made in accordance with FIG. 1 is such that tie wires 18 and 19 restrict the movement of lead wires 13 and 14 within the lamp such that shock is transmitted by way of the lead wires to filament 16. Filament 16 must thus absorb the shock and may permanently deform. Deformation of the filament, as known in the art, may lead to premature or immediate filament failure.

Figure 2:
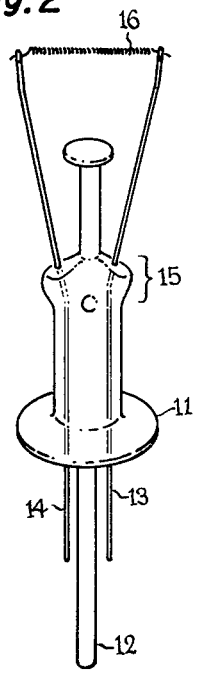
PRIOR ART Fig. 2
FIG. 2 illustrates a mount for an incandescent lamp in accordance with the present invention.

In accordance with the present invention, as illustrated in FIG. 2, the tie wires are eliminated. However, unlike prior art proposals where the tie wires were either simply eliminated or the tie wires were eliminated and lead wires 13 and 14 made heavier, it has been found in accordance with the present invention that inner lead wires having a predetermined stiffness are utilized such that when the lamp is subjected to shock, the lead wires vibrate together thereby minimizing the spatial distortion of filament 16.

It has been found that lead wires having a stiffness number within the range of approximately 300–500 enables one to eliminate the tie wires in a lamp without sacrificing the shock resistance of the lamp. This stiffness number is obtained from what is known in the art as a Tinius Olsen Stiffness Tester, the operation of which may best be understood by a consideration of the chart in FIG. 3 which illustrates the test of a particular sample of lead wire suitable for use in the present invention.

Figure 3:
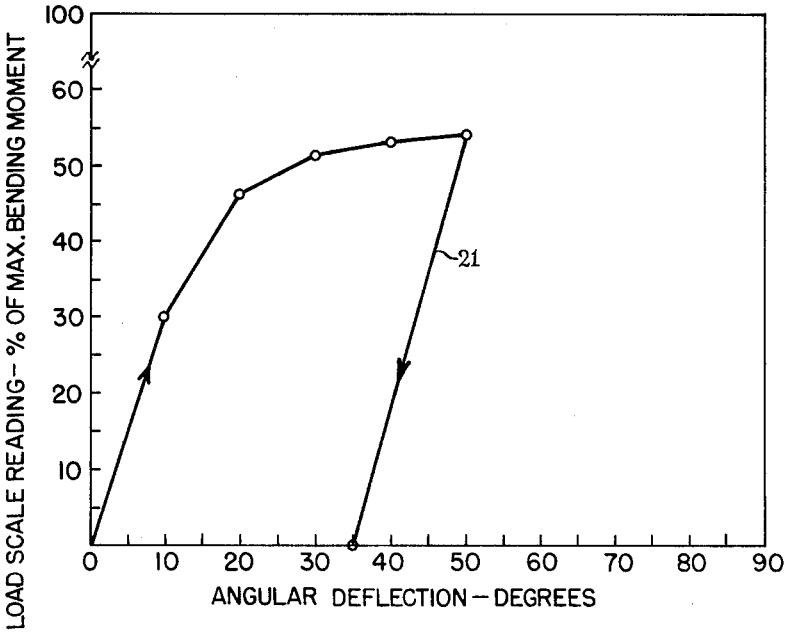
FIG. 3 illustrates the results of a stiffness test on a sample of lead wire having characteristics in accordance with the present invention.

The stiffness test provided by the Tinius Olsen Tester comprises a cantilever mounting of the lead wire while loading the lead wire with a specified force a specified distance from the point of mounting. The applied torque is monitored, expressed as a percent of maximum, and the angular deflection or bending of the wire is also monitored. FIG. 3 illustrates the chart resulting from the test of a particular lead wire. Line 21 in FIG. 3 does not represent the failure or breakage of the lead wire. As can be seen from the shape of the curve up to that point, the deflection of the lead wire quickly approaches a maximum applied torque. Line 21 merely represents the return to zero torque and the resultant "set angle" which the lead wire has taken as a permanent deformation. In the example of FIG. 3, this "set angle" is equal to approximately 15°, ie. the difference between the angle of the last test and the angle reading for zero applied torque (50–35). Since the test does not reach an approximate maximum, 30° was chosen as the angle at which the applied torque would be measured to determine the stiffness number. In this particular case the applied torque was 51% of the maximum torque available as determined when the machine is set up for the test. The stiffness number is obtained by multiplying the maximum torque available by this percentage and by 100. For the particular example illustrated in FIG. 3, the tester was set to a capacity of 0.080 in. lb. Multiplying this by 51 and by 100 yields 408 as the stiffness number. Tests of other samples indicate that a stiffness number between approximately 300 and 500 can be used to produce lamps having no tie wires and no loss of shock resistance.

The range 300–500 is approximate due in part to the variations that may be introduced by the test procedure. Specifically, the data upon which this range is based is also based upon a test distance of one-half inch between the cantilever mounting point and the point at which the load is applied. Theoretically any distance should give the same result, but in practice this may not be so due to a change in the radius of bending, which depends upon the material chosen.

The range is further approximate dependent in part upon the type of lamp in which the lead wires are to be used, ie. different lamps may require a slight shifting, e.g., plus or minus 10%, depending upon the particular lamp. For example, considering FIG. 2, the distance from pressed area 15 to the point at which filament 16 is clamped to the lead wire varies with the wattage and type of lamp. The range 300–500 has been found suitable in lamps having lead wires of approximately 40 millimeters length from pressed area 15 to the point at which filament 16 is clamped. For longer lengths, the range would shift upward and for shorter lengths the range would shift downward. In other words, the vibrating or length/stiffness characteristic of the wire is maintained. The effect may be considered analogous to that of providing vibrating reeds of the same frequency but different lengths.

As is understood by those of skill in the art, the present invention represents an additional test for selecting suitable lead wire, ie. ancillary considerations such as the amount of current to be carried and the corresponding suitable diameter for the lead wire have already been made and candidates for suitable lead wire selected. The range in accordance with the present invention is thus a further test to be performed on lead wire but from which one can come out with reasonable certainty, make lamps which do not require tie wires and which are also not more sensitive to shock than lamps simply made without tie wires.

Having thus described the invention, it will be apparent to those of skill in the art that various modifications may be made within the spirit and scope of the present invention. For example, the adjustment previously described which depends upon the length of the portion of the lead wire protruding into the lamp from the pressed area. Further, while described as the inner lead for a standard incandescent lamp, ie. an incandescent lamp used in what is known in the art as general service household lighting or general service illumination, lead wire in accordance with the present invention may be used with other light sources to improve the ability of the light source to tolerate shock or vibration of the lamp as a whole.

What we claim as new and desire to secure by United States Letters Patent is:

1. In an electric lamp comprising a vitreous envelope, at least two lead wires extending into the interior of said envelope, and a light source connected to the inner ends of said lead wires, the improvement comprising:

the inner portions of said lead wires being characterized by a stiffness of approximately 300–500 and said inner portions vibrating approximately in unison when said lamp is subjected to shock.

2. The lamp as set forth in claim 1 wherein said light source comprises an incandescent filament.

3. The lamp as set forth in claim 2 wherein said inner portions of said lead wires are of approximately equal length.

4. The lamp as set forth in claim 2 wherein said lead wires are further characterized by the absence of tie-wires.

5. The lamp as set forth in claim 2 wherein said inner portions of said lead wires are of unequal length.

* * * * *